US007207819B2

(12) United States Patent
Chen

(10) Patent No.: US 7,207,819 B2
(45) Date of Patent: Apr. 24, 2007

(54) ELECTRICAL CONNECTOR WITH A DETECTIVE SWITCH

(75) Inventor: Ming-Ching Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/518,661

(22) Filed: Sep. 11, 2006

(65) Prior Publication Data

US 2007/0059959 A1 Mar. 15, 2007

(30) Foreign Application Priority Data

Sep. 9, 2005 (CN) ..... 2005 2 0075381

(51) Int. Cl.
*H01R 29/00* (2006.01)

(52) U.S. Cl. ..... 439/188

(58) Field of Classification Search ..... 439/188, 439/489, 159, 160, 152–155
See application file for complete search history.

(56) References Cited

U.S. PATENT DOCUMENTS 5,693,924 A 12/1997 Fetterolf
6,095,837 A 8/2000 David
6,162,078 A * 12/2000 Chung ..... 439/188
6,224,408 B1 * 5/2001 Wu ..... 439/188
6,939,168 B2 * 9/2005 Oleynick et al. ..... 439/541.5
7,083,451 B2 * 8/2006 Zhu et al. ..... 439/188
7,101,230 B2 * 9/2006 Ma ..... 439/668
2004/0033727 A1 * 2/2004 Kao ..... 439/660
2005/0227524 A1 10/2005 Zhuang

* cited by examiner

*Primary Examiner*—Michael C. Zarroli
*Assistant Examiner*—Phuongchi Nguyen
(74) *Attorney, Agent, or Firm*—Wei Te Chung

(57) ABSTRACT

An electrical connector (100) for electrically connecting with a mating connector, includes an insulative housing (1) defining a cavity (16), a number of contacts (2) extending into the cavity, and a detective switch (3) accommodated in the housing (1). The detective switch includes a stationary switch (31) and a movable switch (32). The stationary switch and the movable switch respectively include a first and a second engaging portion (313, 323) for connecting/disconnecting with each other. The movable switch (32) includes a spoon-shaped projecting portion (324) positioned in a free end of the second engaging portion (323) and extending into the cavity (16) for engaging with the mating connector.

12 Claims, 7 Drawing Sheets

ELECTRICAL CONNECTOR WITH A DETECTIVE SWITCH

BACKGROUND OF THE INVENTION

1. Field of the Invention

This invention generally relates to an electrical connector, and more particularly to an electrical connector with a detective switch.

2. Description of the Prior Art

Referring to FIGS. 6–7, U.S. publication No. 20050227524 A1 discloses a modular jack which includes an insulative housing 1' defining a cavity 151' therein, a contact module with a plurality of conductive contacts, and a detective switch 3' disposed in the housing 1'. The detective switch 3' includes a stationary switch 31' and a movable switch 32' for mating with the stationary switch 31'. The stationary switch 31' and the movable switch 32' respectively include an engaging portion 311', 3212' for electrically connecting with each other. The movable switch 32' further has a projecting portion 3211' interiorly bending from the middle section thereof. The projecting portion 3211' extends into the cavity 151' for engaging with a complementary plug. When the corresponding plug is inserted into the cavity 151', it abuts against the projecting portion 3211' and deflects the engaging portion 3212' of the movable switch 32' transversely and outwardly to disconnect with the engaging portion 311' of the stationary switch 31'. As a result, a detective function is realized.

Electronic devices wherein the electrical connectors are mounted, are required to be more and more small in size. The electrical connectors are accordingly required to be more minimized. Under this condition, the projecting portion 3211' is therefore very short with little elasticity, and thus the switch function due to repeated usage may fail.

Hence, an electrical connector with an improved detective switch is desired to overcome the problem above.

BRIEF SUMMARY OF THE INVENTION

Accordingly, an object of the present invention is to provide an electrical connector having a good detective function.

In order to attain the objective above, an electrical connector mounted on a printed circuit board (PCB) for electrically connecting with a corresponding mating connector, includes an insulative housing, a plurality of conductive contacts and a detective switch disposed in the housing, as well as an outer shield enclosing the insulative housing. The insulative housing includes a base portion, a connecting portion extending sideward from the base portion, a cavity for receiving the mating connector, and a tongue plate extending forward from the base portion into the cavity. A plurality of horizontal passageways are disposed in the tongue plate lengthwise for receiving the conductive contacts therein. The detective switch is retained in the connecting portion. The detective switch includes a stationary switch and a movable switch. The stationary switch and the movable switch respectively have a first and a second engaging portion for connecting/disconnecting with each other. The movable switch further includes a spoon-shaped projecting portion positioned in a distal end opposite to the soldering portion. The spoon-shaped projecting portion extends into the cavity for abutting against the mating connector.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
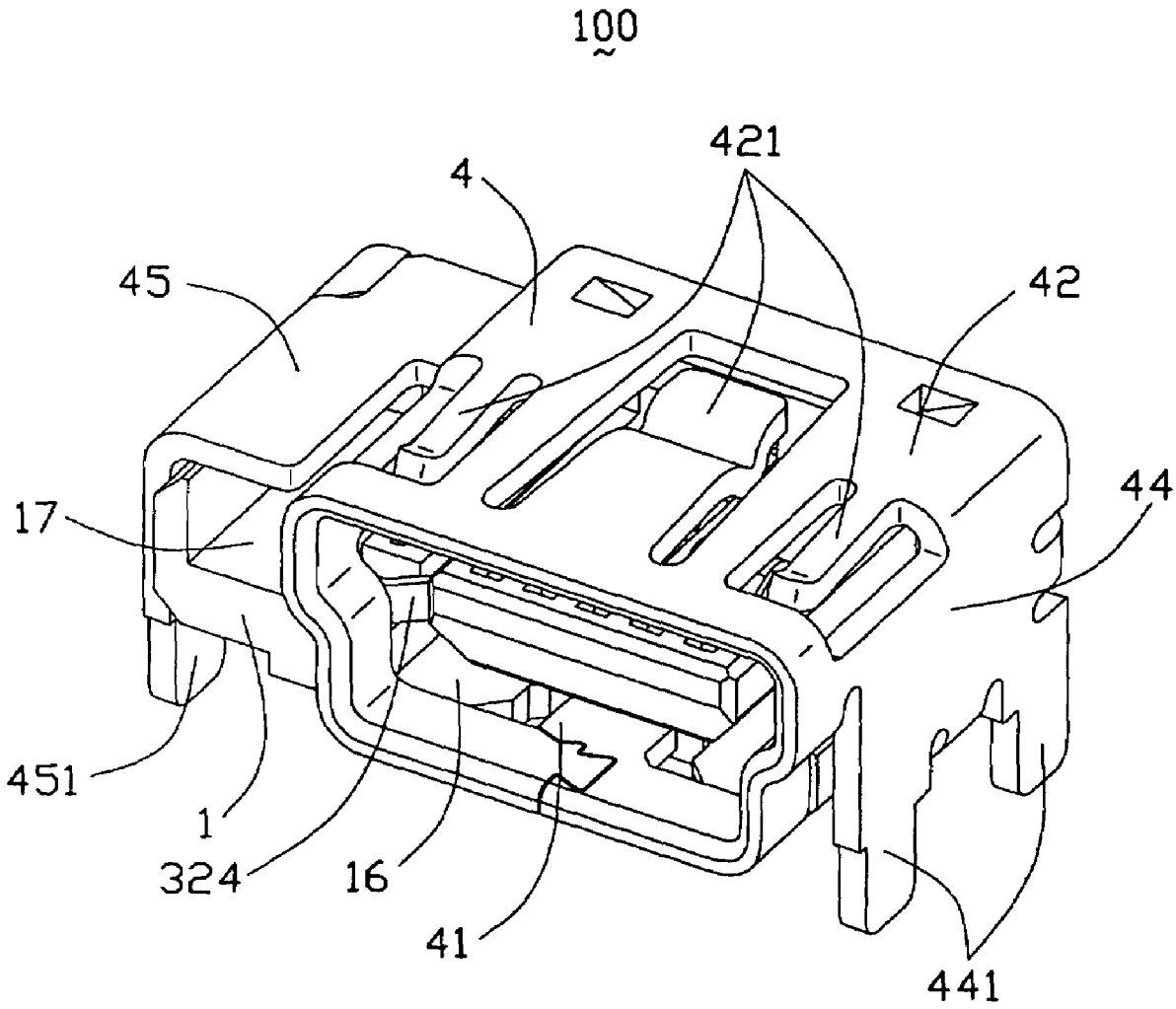
FIG. 1 is a perspective view of an electrical connector according to the present invention.
Figure 2:
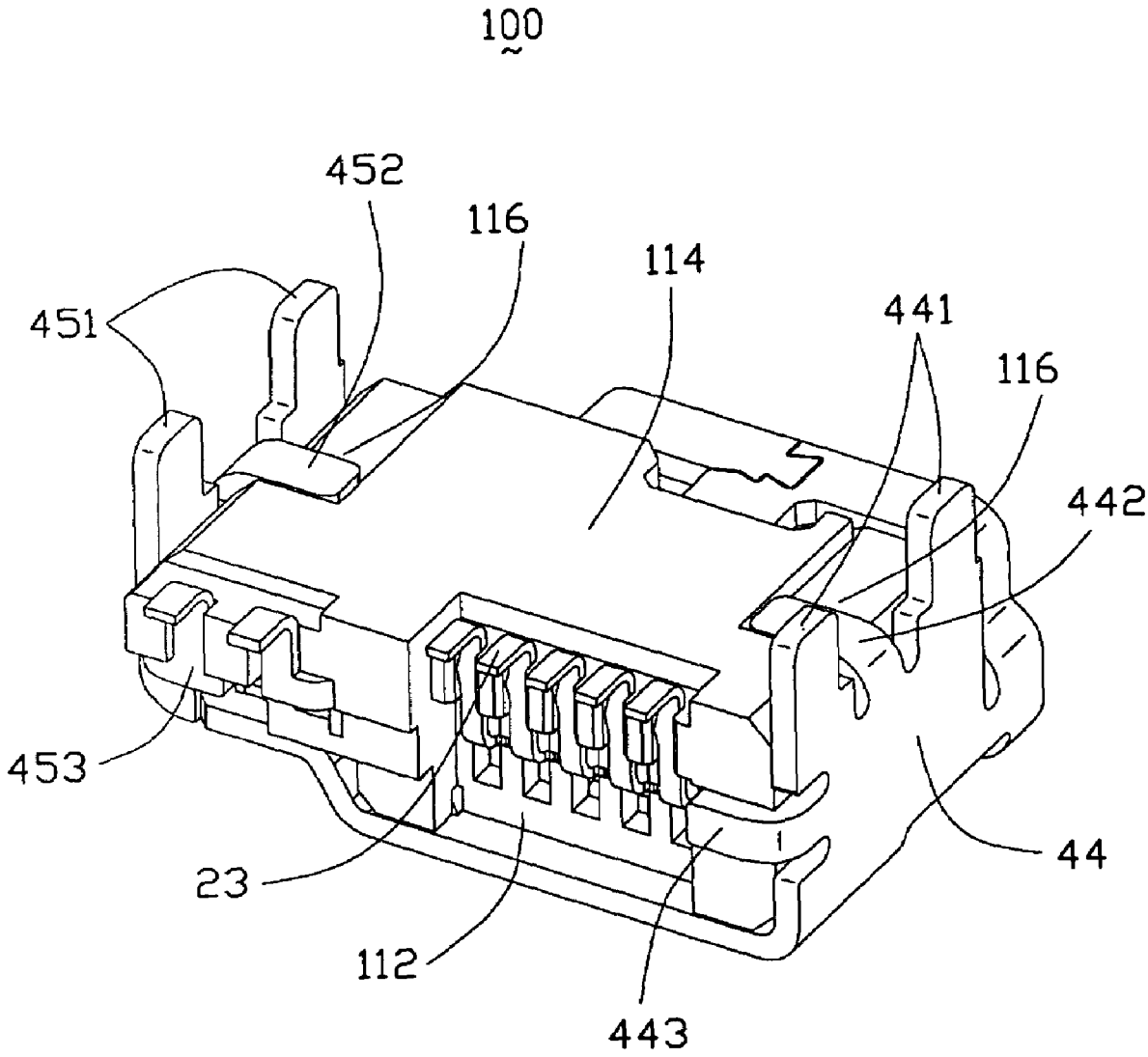
FIG. 2 is another perspective view of the electrical connector.
Figure 3:
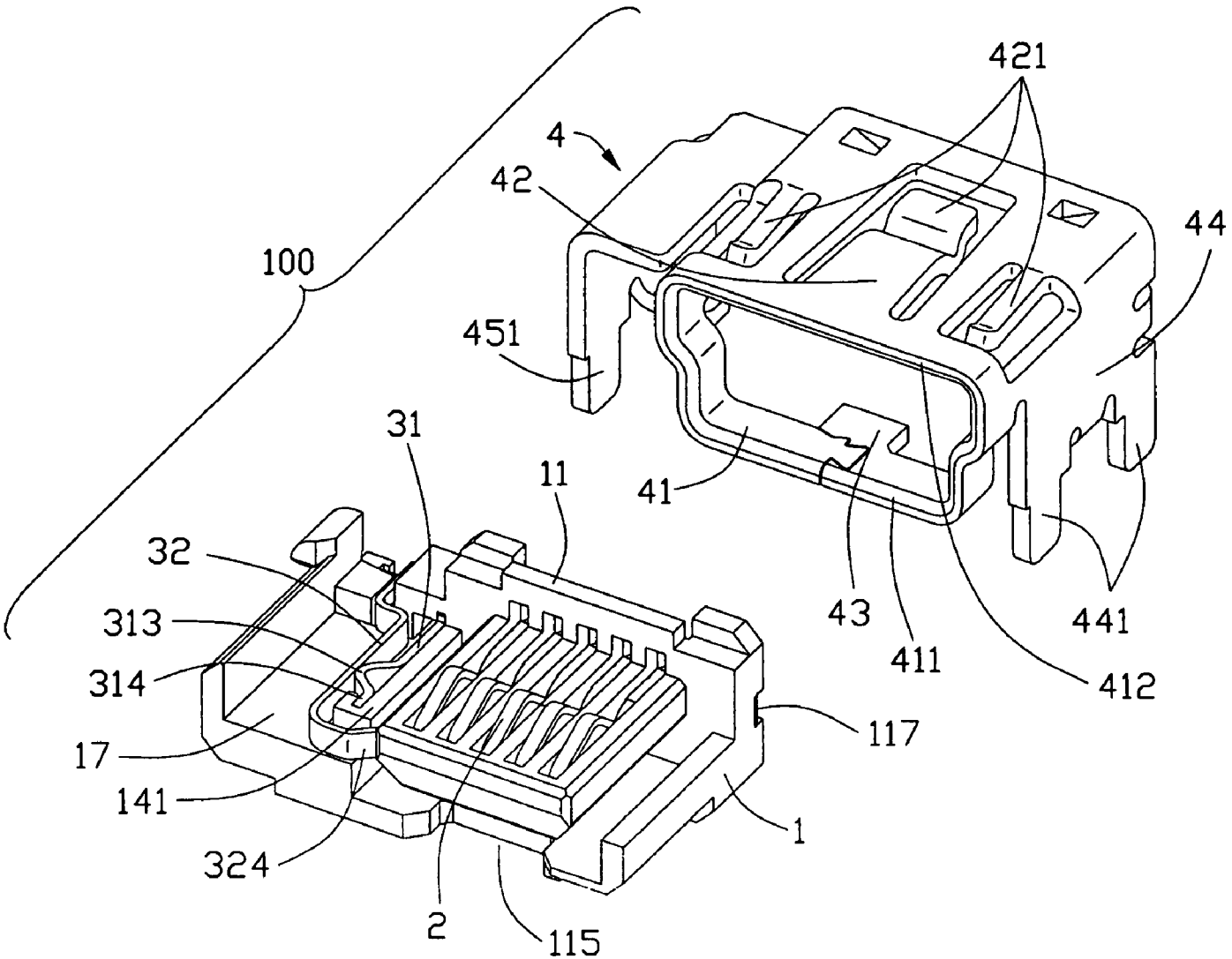
FIG. 3 is a part exploded view of the electrical connector.

Referring to FIGS. 1–3, an electrical connector 100 mounted on a printed circuit board (PCB, not shown) for electrically connecting with a complementary mating connector (not shown), comprises an insulative housing 1, a plurality of conductive contacts 2, and a detective switch 3 retained in the housing 1, as well as an outer shield 4 enclosing the insulative housing 1. The electrical connector 100 of the preferred embodiment is a mini USB connector. The detective switch 3 further includes a stationary switch 31 and a movable switch 32 for engaging/disengaging with the stationary switch 31 according to whether or not the mating connector is inserted into the electrical connector 100.

The insulative housing 1 includes a slight base portion 11, a cavity 16 for receiving the mating connector, a tongue plate 12 extending forward from the front wall 111 of the base portion 11 into the cavity 16, and a connecting portion 13 extending sideward from the base portion 11 for positioning the switch 3 therein. The base portion 11 further defines a plurality of vertical grooves 113 extending through the front wall 111 and the rear wall 112 of the base portion 11 for receiving contacts 2 therethrough. The rear wall 112 of the housing 1 defines a notch 117 adjacent to the grooves 113 for engaging with the shield 4. A plurality of horizontal passageways 121 are disposed in the tongue plate 12 lengthwise corresponding to the grooves 113 for receiving the conductive contacts 2 therein. The connecting portion 13 includes a rear portion 15 communicating with the base portion 11 of the insulative housing 1, a chamber 17 in the front of the rear portion 15, and a comparting portion 14 disposed beside the chamber 17. The comparting portion 14 includes a U-shaped free end 141 with a slit 142 therein for resisting the stationary switch 31. A through hole 151 is positioned at the back of the slit 142 through the rear portion 15 for fixing the stationary switch 31. At the side of the through hole 151, there disposes a slot 152 for fastening the movable switch 31. The insulative housing 1 further includes a bottom wall 114 which defines a cutout 115 in a front and a pair of recesses 116 at two sides of the bottom wall 114 for engaging with the shield 4 (shown in FIG. 2).

Figure 4:
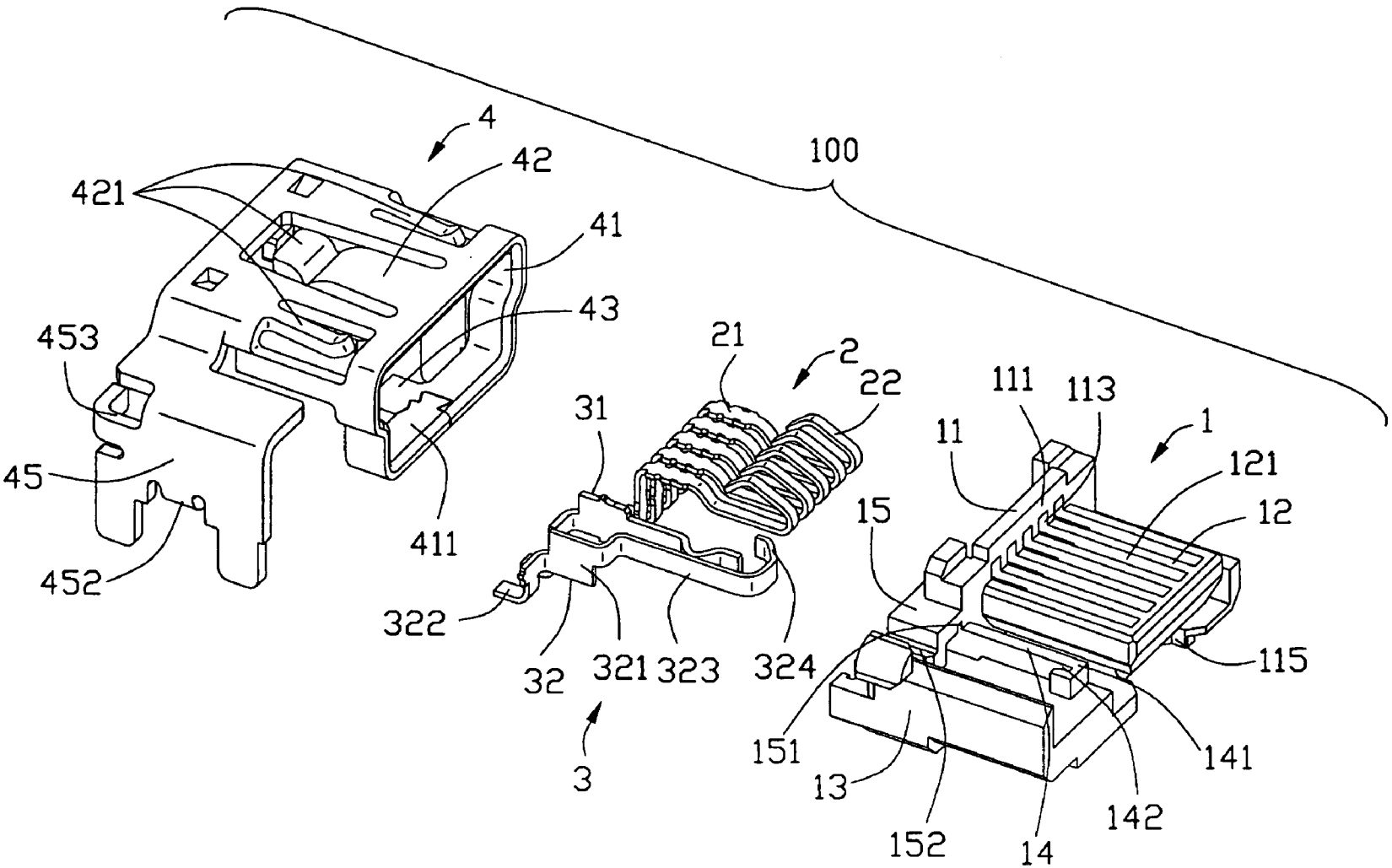
FIG. 4 is an exploded view of the electrical connector.

Further referring to FIG. 4, each conductive contact 2 has a fixing section 21 received in the vertical grooves 113 of the insulative housing 1, a mating section 22 extending upward and backward from an end of the fixing section 21, and a mounting section 23 perpendicularly extending from the other end of the fixing section 21 for being electrically connected to the PCB (not shown). The mating sections 22 extend into the cavity 16 for electrically engaging with the mating connector.

Figure 5:
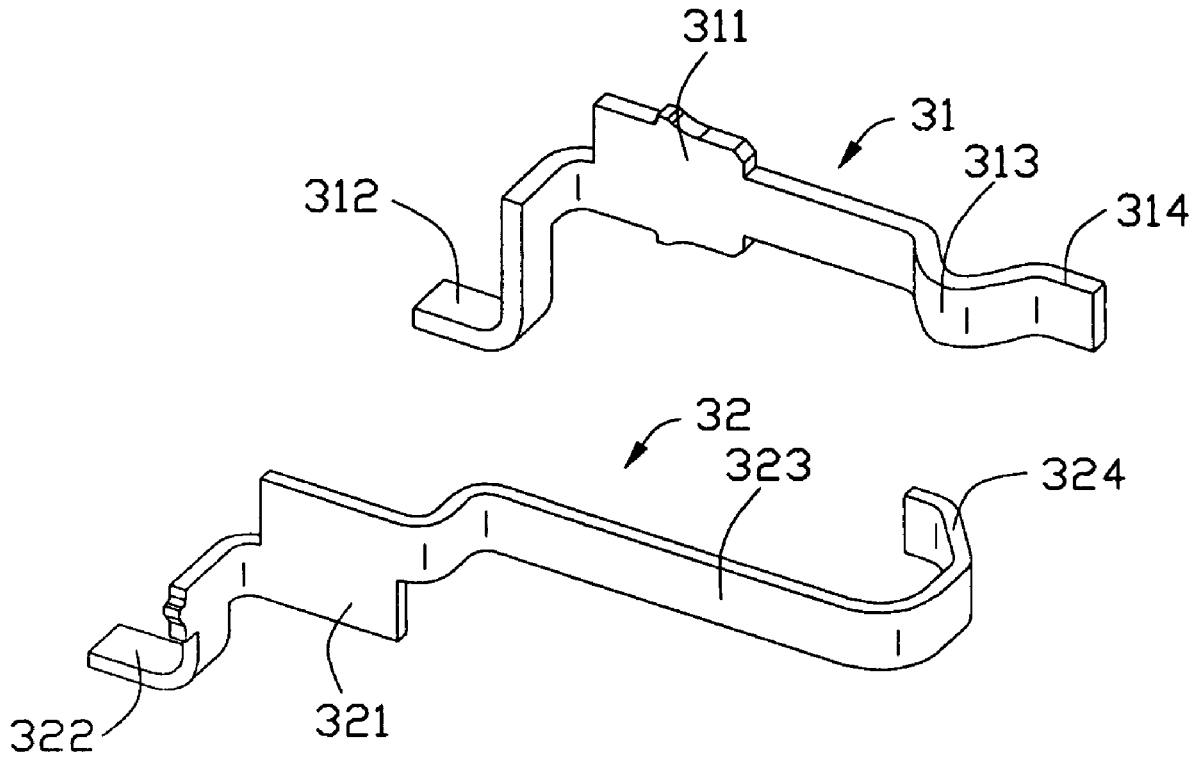
FIG. 5 is a perspective view of the detective switch of the electrical connector.
Figure 6:
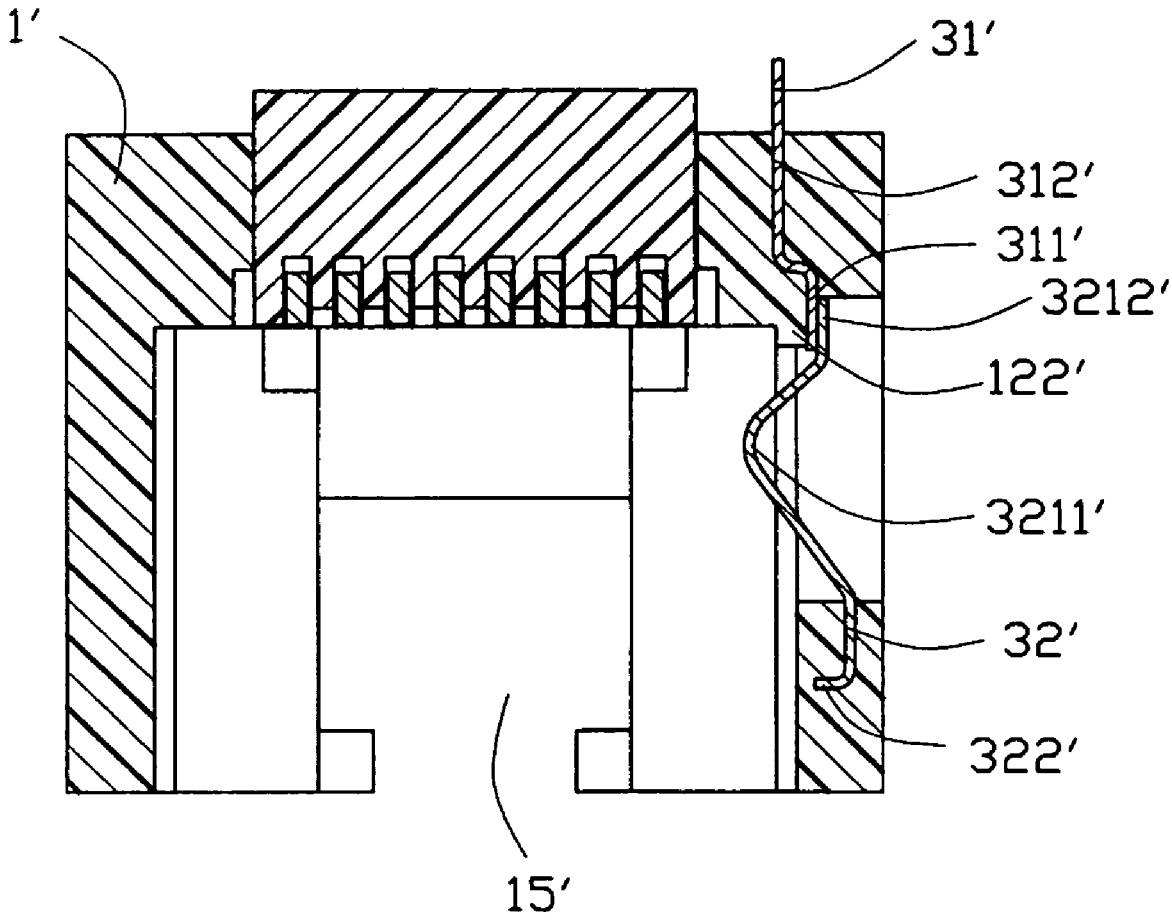
FIG. 6 (PRIOR ART)
FIG. 6 is a cross sectional view of a modular jack with a detective switch of prior art.
Figure 7:
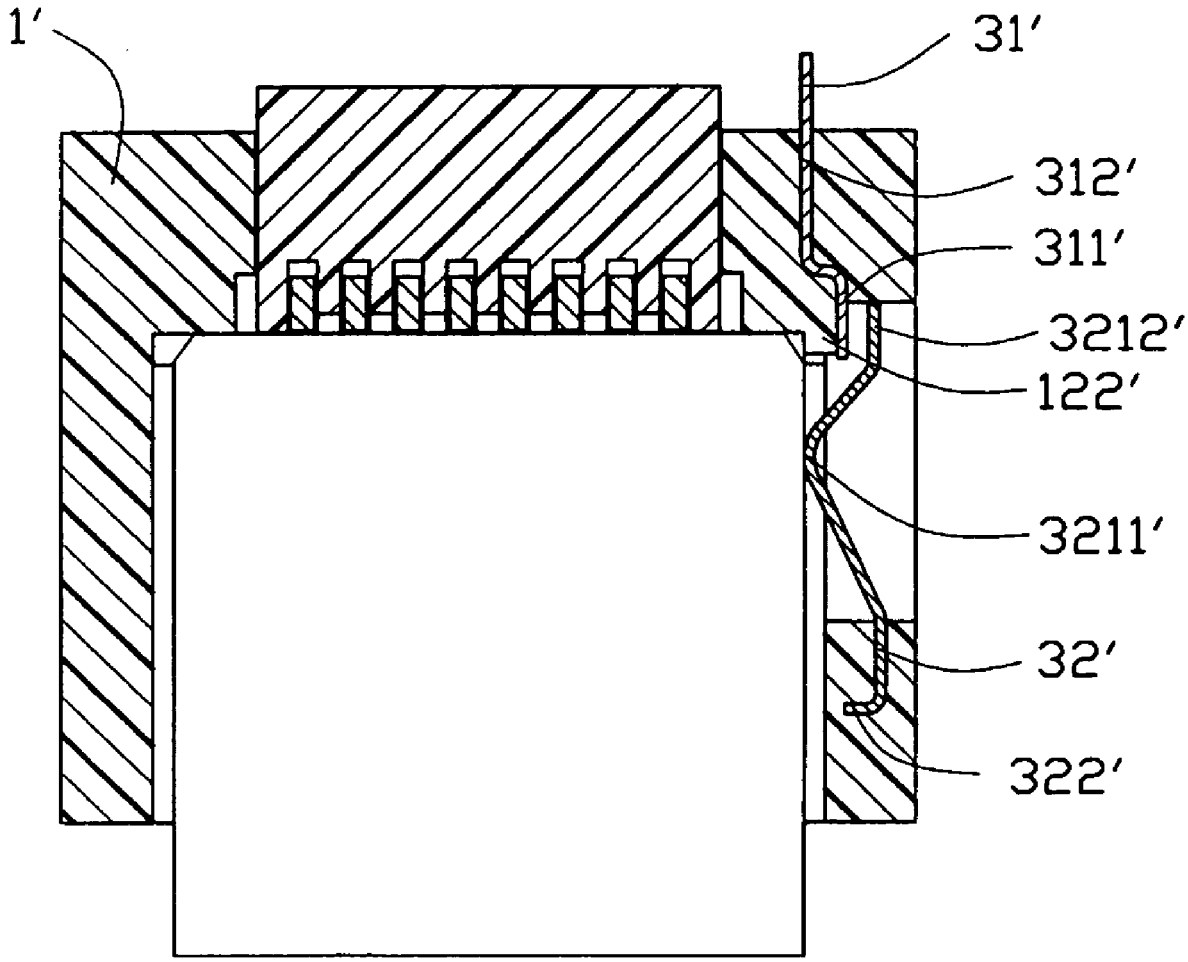
FIG. 7 (PRIOR ART)
FIG. 7 is another cross sectional view of the modular jack with an insertion of a complementary connector.

Referring to FIGS. 4–5, the stationary switch 31 includes a first fixing portion 311, a first soldering portion 312 perpendicularly bending and extending from the back end of the first fixing portion 311. The movable switch 32 includes a second fixing portion 321 retained in the connecting portion 13, and a second soldering portion 322 perpendicularly bending and extending from the back end of the second fixing portion 321 for being mounted on the PCB. The movable switch 32 further includes a second planar engaging portion 323 extending forwardly from the front end of the second fixing portion 321 and a spoon-shaped projecting portion 324 positioned in a free end of the engaging portion 323, wherein the projecting portion 324 extends around the U-shaped free end 141 into the cavity 16 from the chamber 17 for engaging with the mating connector. The stationary switch 31 further includes a first projecting engaging portion 313 for electrically connecting/disconnecting with planar engaging portion 323, and a resistant portion 314 accommodated in the slit 142 of the U-shaped free end 141.

Referring to FIGS. 2–4, the outer shield 4 is stamped from a metal piece. The outer shield 4 includes a closed-type circumferential section 41, a top wall 42 extending backwardly from the upper edge 412 of the circumferential section 41, a tab 43 extending from the lower edge 411 of the circumferential section 41 for positioning in the cutout 115 of the housing 1, and a pair of first and second extending walls 44, 45. The top wall 42 further includes a plurality of tangs 421 extending into the cavity 16 for abutting against the corresponding mating connector. The first extending wall 44 extends downwardly from one side of the top wall 42. The second extending wall 45 is L-shaped and extends from another side of the top wall 42. The second extending wall 45 is on a side of the closed-type circumferential section 41. Besides, the second extending wall 45 surrounds the connecting portion 13. Each of the extending walls 44 includes a couple of soldering tails 441, 451 for being soldered to the PCB. Each extending wall 44 further has a first fixing tail 442, 452 extending inwardly between the soldering tails 441, 451 respectively for mating with the recesses 116 of the bottom wall 114, and a second fixing tail 443, 453 for confronting with the notches 117 of the rear wall 112 of the housing 1 (see FIG. 2).

In assembly, Firstly, the conductive contacts 2 are inserted into corresponding passageways 121 of the plate tongue 12 through the grooves 113 of the rear wall 112 of the insulative housing 1. The fixing sections 21 are received in the vertical grooves 113. The mating sections 22 extend over the passageways 121 for electrically engaging with the mating connector. The mounting sections 23 go beyond the rear wall 112 of the insulative housing 1 to be connected to the PCB. Successively, the detective switch 3 is inserted into the connecting portion 13 from the rear portion 15 wherein the first and second fixing portions 311, 321 are respectively received in the through hole 151 and the slot 152. The resistant portion 314 of the stationary switch 31 is accommodated in the slit 142 of the U-shaped free end 141. The second engaging portion 323 of the movable switch 32 is disposed in the chamber 17. The first engaging portion 313 of the stationary switch 31 extends into the chamber 17 for abutting against the planar engaging portion 323. Meanwhile, the spoon-shaped projecting portion 324 of the movable switch 32 extends around the U-shaped free end 141 into the cavity 16 for touching the mating connector. Finally, the outer shield 4 is assembled surrounding the insulative housing 1 wherein the closed-type circumferential section 41 are set in the front of the tongue plate 12. The first fixing tails 442, 452 engage with the recesses 116 of the bottom wall 114 of the housing 1. The second fixing tails 443, 453 confront with the notches 117 of the rear wall 112 of the housing 1.

In use, when the mating connector is inserted in the cavity 16, it resists the spoon-shaped projecting portion 324 of the movable switch 32 and deflects the second engaging portion 323. The second engaging portion 323 transversely and outwardly moves in the chamber 17 to disconnect with the first engaging portion 313 of the stationary switch 31. As a result, an electrical signal comes in and the detective function is realized.

It is noted that the second engaging portion 323 of the movable switch 32 can be set in a projecting-shape for abutting against the stationary switch 31. In addition, the conductive contacts 2 and the detective switch 3 can also be insert-molded with the insulative housing 1.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A mini USB electrical connector for electrically connecting with a complementary mating connector, comprising:

an insulative housing defining a cavity;

a plurality of contacts retained in the insulative housing and projecting into the cavity; and a detective switch retained in the insulative housing, the detective switch including:

a stationary switch and a movable switch, the stationary switch including a first soldering portion and a first engaging portion, the first engaging portion is projecting-shaped;

the movable switch having a second soldering portion, a second engaging portion for engaging/disengaging with the first engaging portion, and a projecting portion on a free end of the second engaging portion, said projecting portion extending into the cavity and to be deflected by the mating connector; the second engaging portion is planer-shaped; and the projecting portion is spoon-shaped; and the first and second engaging portions are abutting against each other before the mating connector is inserted in the cavity;

the stationary switch includes a first fixing portion connecting the first soldering portion and the first engaging portion; and the movable switch includes a second fixing portion connecting the second soldering portion and the second engaging portion; and the insulative housing includes a base portion defining a plurality of grooves for receiving the contacts therethrough; and the insulative housing includes a tongue plate extending from the base portion, the tongue plate comprising a plurality of passageways corresponding to the grooves for receiving the contacts therein.

2. The electrical connector according to claim 1, wherein the insulative housing includes a connecting portion integrally extending sideward from the base portion for retaining the detective switch.

3. The electrical connector according to claim 2, wherein the connecting portion defines a chamber in which the second engaging portion can move with insertion of the mating connector.

4. The electrical connector according to claim 3, wherein the connecting portion includes a comparting portion disposed beside the chamber, said comparting portion defining a slit, the stationary switch comprising a resistant portion extending from the first engaging portion and accommodated in the slit.

5. The electrical connector according to claim 3, wherein the first engaging portion projects into the chamber for abutting against the movable switch before insertion of the mating connector.

6. The electrical connector according to claim 2, further comprising an outer shield enclosing the insulative housing, the shield defining a closed-type circumferential section, a top wall extending backwardly from an upper edge of the circumferential section, and a second extending wall extending from a side of the top wall, the second extending wall being on a side of the closed-type circumferential section.

7. The electrical connector according to claim 6, wherein the second extending wall is L-shaped and surrounds the connecting portion.

8. The electrical connector according to claim 6, wherein the outer shield is stamped from a metal piece.

9. A mini USB electrical connector for electrically connecting with a complementary mating connector, comprising:

an insulative housing defining a cavity;

a plurality of contacts retained in the insulative housing and projecting into the cavity; and a detective switch retained in the insulative housing, the detective switch including:

a stationary switch and a movable switch, the stationary switch including a first soldering portion and a first engaging portion, the first engaging portion is projecting-shaped;

the movable switch having a second soldering portion, a second engaging portion for engaging/disengaging with the first engaging portion, and a projecting portion on a free end of the second engaging portion, said projecting portion extending into the cavity and to be deflected by the mating connector; the second engaging portion is planer-shaped; and the projecting portion is spoon-shaped; and at least one of said first engaging portion and said second engaging portion forms a contacting apex abutting against a planar section of the other;

the stationary switch includes a first fixing portion connecting the first soldering portion and the first engaging portion; and the movable switch includes a second fixing portion connecting the second soldering portion and the second engaging portion; and the insulative housing includes a base portion defining a plurality of grooves for receiving the contacts therethrough; and the insulative housing includes a tongue plate extending from the base portion, the tongue plate comprising a plurality of passageways corresponding to the grooves for receiving the contacts therein.

10. The connector as claimed in claim 9, wherein said movable switch is cantilevered, and the projecting portion is located at a free end while an engagement position between the first engaging portion and the second engaging portion is located at an intermediate section of said movable switch.

11. A mini USB electrical connector for electrically connecting with a complementary mating connector, comprising:

an insulative housing defining a cavity;

a plurality of contacts retained in the insulative housing and projecting into the cavity; and a metallic shell enclosing the housing and defining a receiving cavity into which the contacts extend;

a chamber formed by both the housing and the shell and located beside said receiving cavity; and a detective switch retained in the insulative housing, the detective switch including:

a stationary switch and a movable switch, the stationary switch including a first soldering portion and a first engaging portion, the first engaging portion is projecting-shaped;

the movable switch having a second soldering portion, a second engaging portion for engaging/disengaging with the first engaging portion, and a projecting portion on a free end of the second engaging portion, said projecting portion extending into the cavity and to be deflected by the mating connector; the second engaging portion is planer-shaped; and the projecting portion is spoon-shaped; and the first and second engaging portions are abutting against each other before the mating connector is inserted in the cavity;

the stationary switch includes a first fixing portion connecting the first soldering portion and the first engaging portion; and the movable switch includes a second fixing portion connecting the second soldering portion and the second engaging portion; and the insulative housing includes a base portion defining a plurality of grooves for receiving the contacts therethrough; and the insulative housing includes a tongue plate extending from the base portion, the tongue plate comprising a plurality of passageways corresponding to the grooves for receiving the contacts therein.

12. The connector as claimed in claim 11, wherein said shell is unitary.

* * * * *